US006412178B1

(12) United States Patent
Vicedomini

(10) Patent No.: US 6,412,178 B1
(45) Date of Patent: Jul. 2, 2002

(54) WALLPAPER CUTTING TOOL FOR CORNERS

(76) Inventor: Ralph Vicedomini, 365 Marvin Ave., Hackensack, NJ (US) 07601

( * ) Notice: Subject to any disclaimer, the term of this patent is extended or adjusted under 35 U.S.C. 154(b) by 67 days.

(21) Appl. No.: 09/680,731

(22) Filed: Oct. 6, 2000

(51) Int. Cl.[7] ..... B26B 29/06
(52) U.S. Cl. ..... 30/294; 30/317
(58) Field of Search ..... 30/294, 2, 289, 30/317

(56) References Cited

U.S. PATENT DOCUMENTS

| | | | | | |
|---|---|---|---|---|---|
| 3,349,486 | A | * | 10/1967 | Voight | 30/294 |
| 3,395,453 | A | * | 8/1968 | Prater | 30/293 |
| 3,500,540 | A | * | 3/1970 | Lundquist | 30/294 |
| 3,504,435 | A | * | 4/1970 | Sloboda et al. | 30/293 |
| 3,991,467 | A | * | 11/1976 | Yokoyama | 30/293 |
| 4,041,605 | A | * | 8/1977 | Selfridge | 30/293 |
| 4,043,038 | A | * | 8/1977 | Selfridge | 30/293 |
| 4,077,124 | A | * | 3/1978 | Christmann | 30/287 |
| 4,408,396 | A | * | 10/1983 | Scholl | 30/294 |
| 4,602,433 | A | * | 7/1986 | Whiting | 30/162 |
| 4,817,290 | A | * | 4/1989 | Baughman | 30/293 |
| 6,321,454 | B1 | * | 11/2001 | Wass | 30/123 |

FOREIGN PATENT DOCUMENTS

| | | | |
|---|---|---|---|
| DE | 2724915 | * | 12/1978 |
| DE | 3617944 A1 | * | 12/1987 |

* cited by examiner

*Primary Examiner*—Kenneth E. Peterson
(74) *Attorney, Agent, or Firm*—Goldstein & Lavas, P.C.

(57) ABSTRACT

A wallpaper cutting tool for corners including a plate having a planar upper surface, a planar lower surface, an upper edge, a lower edge, and opposed side edges. The planar upper surface has a handle secured thereto. The planar lower surface has a central groove formed therein extending between the upper and lower edges thereof. A cutting blade is disposed within the central groove of the planar lower surface of the plate. A right angle plate is secured to the planar lower surface of the plate in an abutting relationship with the cutting blade.

5 Claims, 2 Drawing Sheets

WALLPAPER CUTTING TOOL FOR CORNERS

BACKGROUND OF THE INVENTION

The present invention relates to a wallpaper cutting tool for corners and more particularly pertains to cutting wallpaper at the corner formed by a pair of walls meeting together at a ninety degree angle.

Most wall paper jobs involve the covering of more than one wall. Typically, the most difficult task in these types of wallpaper jobs revolves around the cutting of the wallpaper into corners in order to obtain a clean cut appearance without a great struggle. Alternately, the wallpaper would need to fit the paper evenly into the corner with a plastic putty knife or other facsimile which frequently will cause the wallpaper to tear if the paper is forced into the corner. What is needed is a tool that is specifically designed to smoothly cut wallpaper within corner formed by the convergence of two walls.

The present invention attempts to solve the abovementioned problem by providing a device that is specifically constructed for cutting along the corner formed between two walls in order to create a neat cut edge within the corner.

The use of cutting devices is known in the prior art. More specifically, cutting devices heretofore devised and utilized for the purpose of allowing items to be neatly cut are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,794,350 to Shand discloses a utility knife with adapters allowing for angular cuts. U.S. Pat. No. 4,077,124 to Christmann discloses a tool for cutting and applying sheet material such as wallpaper. U.S. Pat. No. 4,989,335 to Day discloses a wallpaper knife guide with a right angled lip portion for pushing sheets of paper into a corner. U.S. Pat. No. 5,012,581 to Fletcher discloses a utility knife suited to be used by either right or left handed people.

While these devices fulfill their respective, particular objective and requirements, the aforementioned patents do not describe a wallpaper cutting tool for corners for cutting wallpaper at the corner formed by a pair of walls meeting together at a ninety degree angle.

In this respect, the wallpaper cutting tool for corners according to the present invention substantially departs from the conventional concepts and designs of the prior art, and in doing so provides an apparatus primarily developed for the purpose of cutting wallpaper at the corner formed by a pair of walls meeting together at a ninety degree angle.

Therefore, it can be appreciated that there exists a continuing need for a new and improved wallpaper cutting tool for corners which can be used for cutting wallpaper at the corner formed by a pair of walls meeting together at a ninety degree angle. In this regard, the present invention substantially fulfills this need.

SUMMARY OF THE INVENTION

In the view of the foregoing disadvantages inherent in the known types of cutting devices now present in the prior art, the present invention provides an improved wallpaper cutting tool for corners. As such, the general purpose of the present invention, which will be described subsequently in greater detail, is to provide a new and improved wallpaper cutting tool for corners which has all the advantages of the prior art and none of the disadvantages.

To attain this, the present invention essentially comprises a plate having a generally rectangular configuration. The plate has a planar upper surface, a planar lower surface, a short upper edge, a short lower edge, and opposed long side edges. The planar upper surface has a handle secured thereto. The planar lower surface has a central groove formed therein extending between the short upper and lower edges thereof. A cutting blade is disposed within the central groove of the planar lower surface of the plate. The cutting blade has an upper portion extending upwardly beyond the short upper edge of the plate. The upper portion is beveled. A right angle plate is secured to the planar lower surface of the plate. The right angle plate is comprised of a pair of angular plates. Each of the angular plates has lower edges and upper edges. The lower edges are secured to the opposed long side edges of the plate. The upper edges are positioned in an abutting relationship with the cutting blade.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved wallpaper cutting tool for corners which has all the advantages of the prior art cutting devices and none of the disadvantages.

It is another object of the present invention to provide a new and improved wallpaper cutting tool for corners which may be easily and efficiently manufactured and marketed.

It is a further object of the present invention to provide a new and improved wallpaper cutting tool for corners which is of durable and reliable construction.

An even further object of the present invention is to provide a new and improved wallpaper cutting tool for corners which is susceptible of a low cost of manufacture with regard to both materials and labor, and which accordingly is then susceptible of low prices of sale to the consuming public, thereby making such a wallpaper cutting tool for corners economically available to the buying public.

Even still another object of the present invention is to provide a new and improved wallpaper cutting tool for corners for cutting wallpaper at the corner formed by a pair of walls meeting together at a ninety degree angle.

Lastly, it is an object of the present invention to provide a new and improved wallpaper cutting tool for corners including a plate having a planar upper surface, a planar lower surface, an upper edge, a lower edge, and opposed side edges. The planar upper surface has a handle secured thereto. The planar lower surface has a central groove formed therein extending between the upper and lower edges thereof. A cutting blade is disposed within the central groove of the planar lower surface of the plate. A right angle plate is secured to the planar lower surface of the plate in an abutting relationship with the cutting blade.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
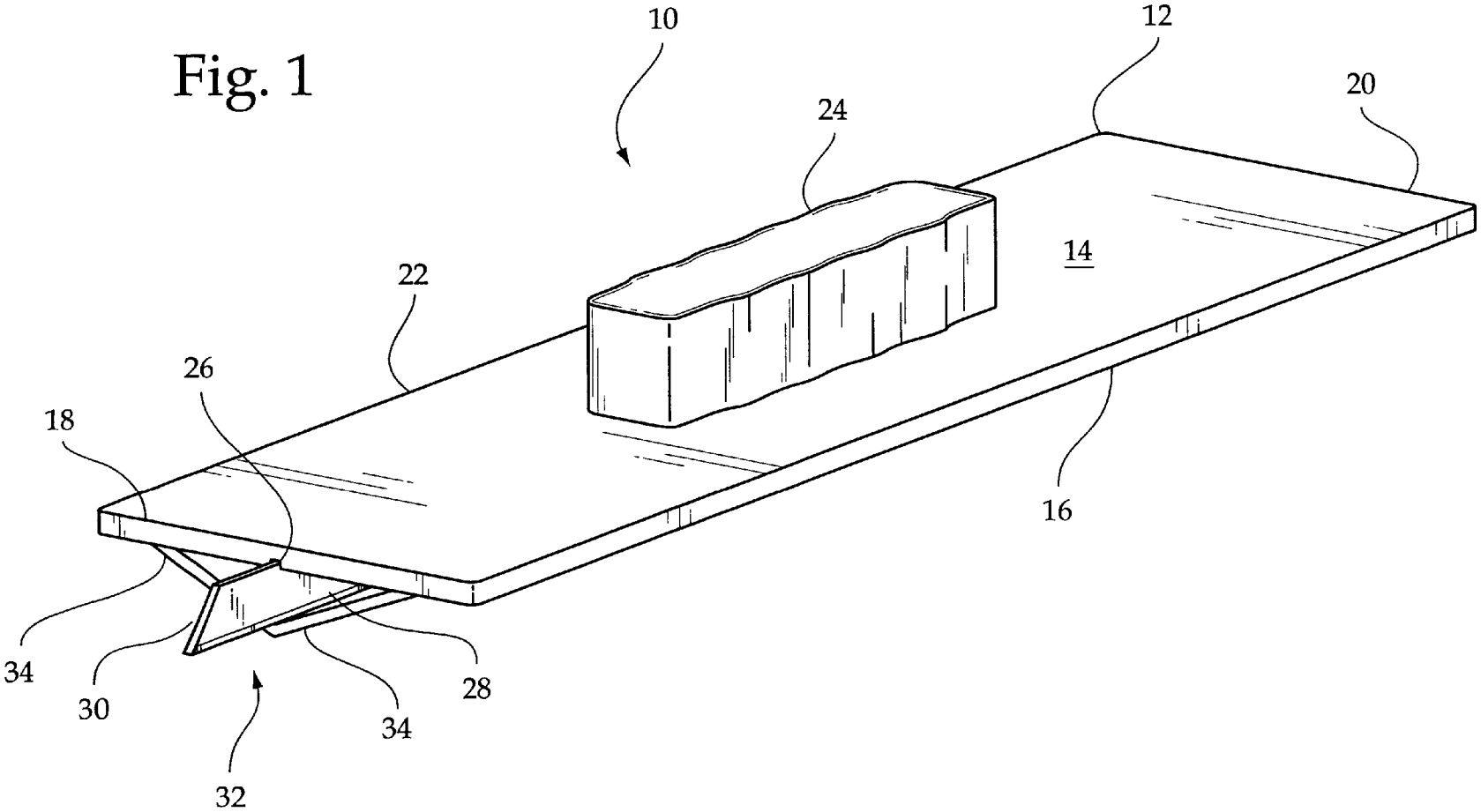
FIG. 1 is a perspective view of the preferred embodiment of the wallpaper cutting tool for corners constructed in accordance with the principles of the present invention.
Figure 2:
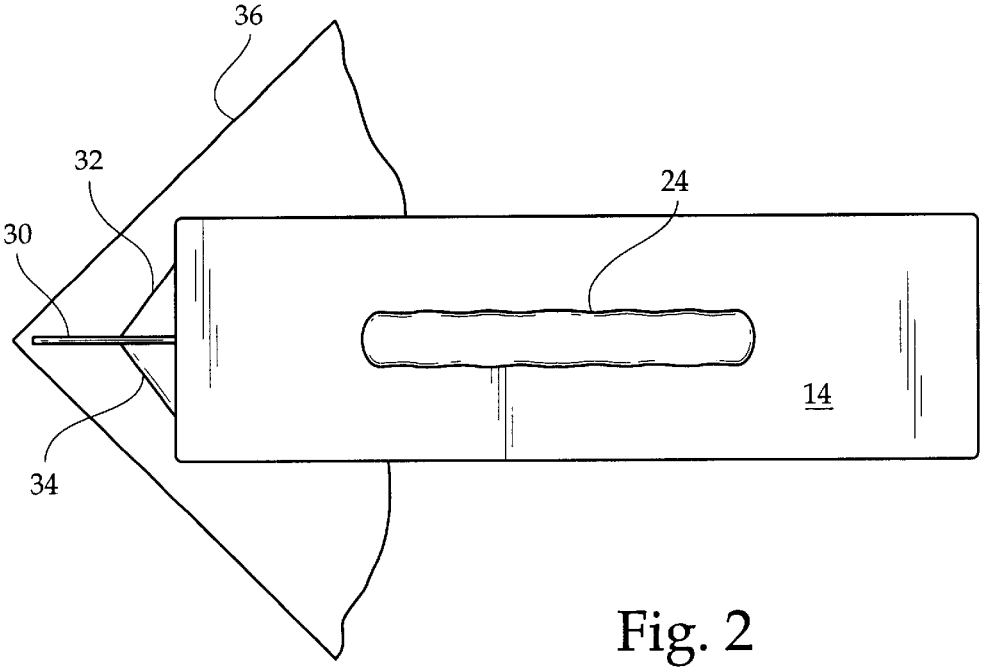
FIG. 2 is a plan view of the present invention illustrated in preparation for use.
Figure 3:
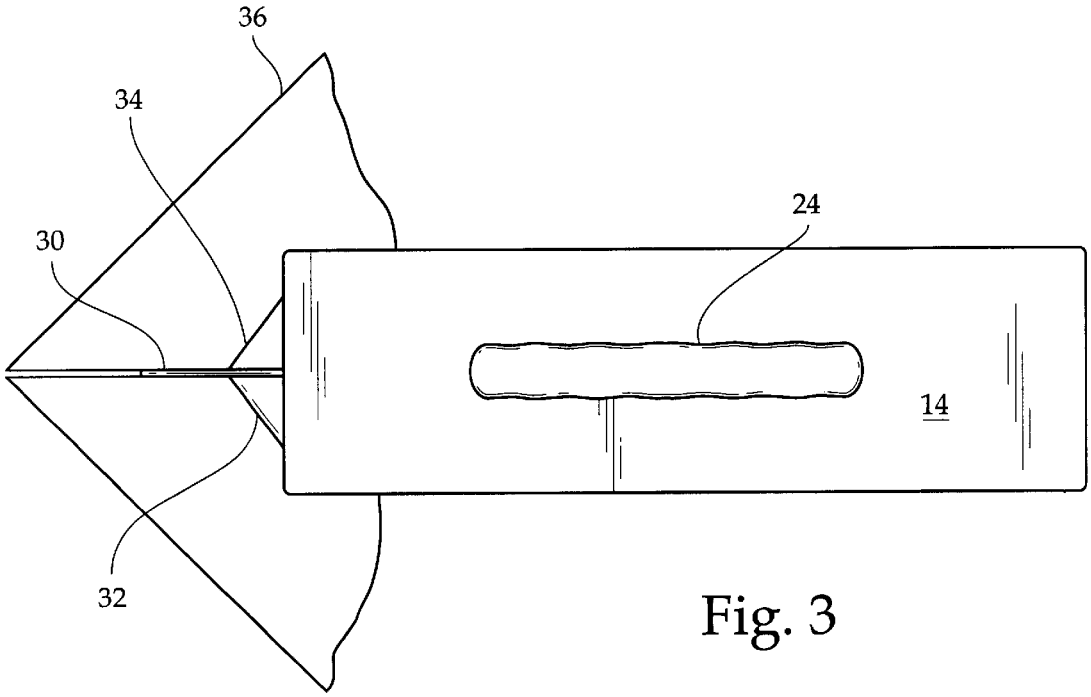
FIG. 3 is a plan view of the present invention illustrated in use.

With reference now to the drawings, and in particular, to FIGS. 1 through 3 thereof, the preferred embodiment of the new and improved wallpaper cutting tool for corners embodying the principles and concepts of the present invention and generally designated by the reference number 10 will be described.

Specifically, it will be noted in the various figures that the device relates to a wallpaper cutting tool for corners for cutting wallpaper at the corner formed by a pair of walls meeting together at a ninety degree angle. In its broadest context, the device consists of a plate, a cutting blade, and a right angle plate. Such components are individually configured and correlated with respect to each other so as to attain the desired objective.

The plate 12 has a generally rectangular configuration. The plate 12 has a planar upper surface 14, a planar lower surface 16, a short upper edge 18, a short lower edge 20, and opposed long side edges 22. The planar upper surface 14 has a handle 24 secured thereto. The handle 24 can be constructed with a series of indentations to facilitate handling of the device 10. Alternately, the handle 24 can be designed to conform to certain grips. The planar lower surface 16 has a central groove 26 formed therein extending between the short upper and lower edges 18, 20 thereof.

The cutting blade 28 is disposed within the central groove 26 of the planar lower surface 16 of the plate 12. The cutting blade 28 has an upper portion 30 extending upwardly beyond the short upper edge 18 of the plate 12. The upper portion 30 is beveled to form a sharp cutting edge. The cutting blade 28 can be removed when it becomes dull and replaced by a new cutting blade 28. Additionally, the cutting blade 28 should be sharp enough to pierce and cut wallpaper when the tool is angled relative to the line of the corner.

The right angle plate 32 is secured to the planar lower surface 16 of the plate 12. The right angle plate 32 is comprised of a pair of angular plates 34. Each of the angular plates 34 has lower edges and upper edges. The lower edges are secured near the opposed long side edges 22 of the plate 12. The upper edges are positioned in an abutting relationship with the cutting blade 28 The right angle plate 32, when the present invention is in use, will abut the walls forming the corner that is being cut by the cutting blade 28. The angular plates 34 will be positioned against these walls as the cutting blade 28 is positioned within the corner. The device 10 is pressed against the corner and the .converging walls using easy, but constant pressure. The device 10 is then slid down along the corner allowing the cutting blade 28 to make an even cut of the wallpaper 36 within the corner. Note FIGS. 2 and 3.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A wallpaper cutting tool for corners for cutting wallpaper at the corner formed by a pair of walls meeting together at a ninety degree angle comprising, in combination:

a plate having a generally rectangular configuration, the plate having a planar upper surface, a planar lower surface, a short upper edge, a short lower edge, and opposed long side edges, the planar upper surface having a handle secured thereto, the planar lower surface having a central groove formed therein extending between the short upper and lower edges thereof;

a cutting blade disposed within the central groove of the planar lower surface of the plate, the cutting blade having an upper portion extending upwardly beyond the short upper edge of the plate, the upper portion being beveled; and a right angle plate secured to the planar lower surface of the plate, the right angle plate being comprised of a pair of angular plates, each of the angular plates having lower edges and upper edges, the lower edges being secured near the opposed long side edges of the plate, the upper edges being positioned in an abutting relationship with the cutting blade.

2. A wallpaper cutting tool for corners for cutting wallpaper at the corner formed by a pair of walls meeting together at a ninety degree angle comprising, in combination:

a plate having a planar upper surface, a planar lower surface, an upper edge, a lower edge, and opposed side edges, the planar upper surface having a handle secured thereto, the planar lower surface having a central groove formed therein extending between the upper and lower edges thereof;

a cutting blade disposed within the central groove of the planar lower surface of the plate, the cutting blade an upper portion extending upwardly beyond the short upper edge of the plate; and a right angle plate secured to the planar lower surface of the plate, the right angle plate being comprised of a pair of angular plates being positioned in an abutting relationship with the cutting blade.

3. The wallpaper cutting tool for corners as set forth in claim 2, wherein the cutting blade has an upper portion extending upwardly beyond the short upper edge of the plate.

4. The wallpaper cutting tool for corners as set forth in claim 3, wherein the upper portion of the cutting blade is beveled.

5. The wallpaper cutting tool for corners as set forth in claim 3, wherein each of the angular plates has lower edges and upper edges, the lower edges being secured to the opposed side edges of the plate, the upper edges being positioned in an abutting relationship with the cutting blade.

* * * * *